US009011180B2

(12) United States Patent
Sharaf et al.

(10) Patent No.: US 9,011,180 B2
(45) Date of Patent: Apr. 21, 2015

(54) CONNECTOR WITH INTEGRATED FUSE

(71) Applicants: Nadir Sharaf, Bloomfield Township, MI (US); Aric Anglin, Rives Junction, MI (US); Reinhard Pusch, Farmington Hills, MI (US); Slobodan Pavlovic, Novi, MI (US); Michael Hardy, Ypsilanti, MI (US)

(72) Inventors: Nadir Sharaf, Bloomfield Township, MI (US); Aric Anglin, Rives Junction, MI (US); Reinhard Pusch, Farmington Hills, MI (US); Slobodan Pavlovic, Novi, MI (US); Michael Hardy, Ypsilanti, MI (US)

(73) Assignee: Lear Corporation, Southfield, MI (US)

( * ) Notice: Subject to any disclaimer, the term of this patent is extended or adjusted under 35 U.S.C. 154(b) by 31 days.

(21) Appl. No.: 13/750,758

(22) Filed: Jan. 25, 2013

(65) Prior Publication Data

US 2014/0011404 A1 Jan. 9, 2014

Related U.S. Application Data

(60) Provisional application No. 61/591,085, filed on Jan. 26, 2012.

(51) Int. Cl.

| | |
|---|---|
| ***H01R 13/68*** | (2011.01) |
| ***H01R 13/684*** | (2011.01) |
| *H01R 13/44* | (2006.01) |
| *H01R 107/00* | (2006.01) |

(52) U.S. Cl.

CPC ..... *H01R 13/68* (2013.01); *H01R 13/44* (2013.01); *H01R 13/684* (2013.01); *H01R 2107/00* (2013.01)

(58) Field of Classification Search

CPC ..... H01R 13/68; H01R 24/28; H01R 31/02; H01H 85/2035; H01H 85/2045

USPC ..... 439/620.26–620.33

See application file for complete search history.

(56) References Cited

U.S. PATENT DOCUMENTS

| | | | | |
|---|---|---|---|---|
| 3,976,967 | A | 8/1976 | Magherini | |
| 4,968,264 | A * | 11/1990 | Ruehl et al. | 439/620.29 |
| 5,634,818 | A | 6/1997 | Deng | |
| 6,267,627 | B1 | 7/2001 | Lin | |
| 6,325,673 | B1 * | 12/2001 | Mai | 439/620.31 |
| 6,468,111 | B1 * | 10/2002 | Weng | 439/620.3 |
| 6,547,600 | B2 * | 4/2003 | Yen | 439/620.3 |
| 6,652,321 | B2 * | 11/2003 | Liu | 439/620.3 |
| 6,814,621 | B2 * | 11/2004 | Lu | 439/620.29 |
| 7,613,003 | B2 | 11/2009 | Pavlovic et al. | |
| 7,705,706 | B2 | 4/2010 | Ding | |
| 7,729,117 | B2 | 6/2010 | Schweinbenz et al. | |
| 7,740,504 | B2 * | 6/2010 | Chikamatsu et al. | 439/620.3 |
| 7,985,098 | B2 | 7/2011 | De Chazal et al. | |
| 8,098,126 | B2 | 1/2012 | Niedzwiecki et al. | |
| 8,221,165 | B2 | 7/2012 | DeWitte | |
| 2003/0207618 | A1 * | 11/2003 | Chen | 439/622 |
| 2004/0166736 | A1 * | 8/2004 | Gibboney | 439/621 |

* cited by examiner

*Primary Examiner* — Gary Paumen

(74) *Attorney, Agent, or Firm* — MacMillan, Sobanski & Todd, LLC

(57) ABSTRACT

An electrical connector includes a connector body and at least two electric terminals. A fuse is supported on the connector body and at least one of the electric terminals is supported by the fuse.

11 Claims, 4 Drawing Sheets

CONNECTOR WITH INTEGRATED FUSE

CROSS-REFERENCE TO RELATED APPLICATIONS

This application claims the benefit of U.S. Provisional Application No. 61/591,085, filed Jan. 26, 2012, the disclosure of which is incorporated herein by reference.

BACKGROUND OF THE INVENTION

This invention relates in general to an electric circuit including a fuse. More particularly this invention relates to a fuse that is integrated with an electrical connector.

Electric vehicles use a source of high voltage electric power, such as batteries or fuel cells. This electric power is distributed along various electric pathways for the operation of various vehicle systems and components.

The electric pathways are electric circuits that typically include a fuse in order to protect against power surges. The fuse is also a safety feature intended to help prevent accidental electrocution, for example of someone conducting service or maintenance on the vehicle. An electric vehicle may include multiple high voltage fuses.

SUMMARY OF THE INVENTION

This invention relates to an electrical connector. The electrical connector includes a connector body. The electrical connector includes at least two electric terminals. The electrical connector includes a fuse supported on the connector body. At least one of the electric terminals is supported by the fuse. An associated electrical connector is capable of mating with the connector body. The fuse is accessible when the connector body is not mated with the associated electrical connector. The fuse is not accessible when the connector body is mated with the associated electrical connector. The fuse is exposed for service when the connector body is not mated with the associated electrical connector. An end cap on the fuse has a shape of a terminal. The end cap on the fuse can engage a corresponding terminal on the associated electrical connector when the connector body is mated with the associated electrical connector. The fuse is removable from the connector body. If the fuse is not installed in the connector body there will be no contact between the blade terminal and the corresponding terminal when the connector body is mated with the associated electrical connector.

Various aspects of this invention will become apparent to those skilled in the art from the following detailed description of the preferred embodiment, when read in light of the accompanying drawings.

DETAILED DESCRIPTION OF THE PREFERRED EMBODIMENT

Figure 1:
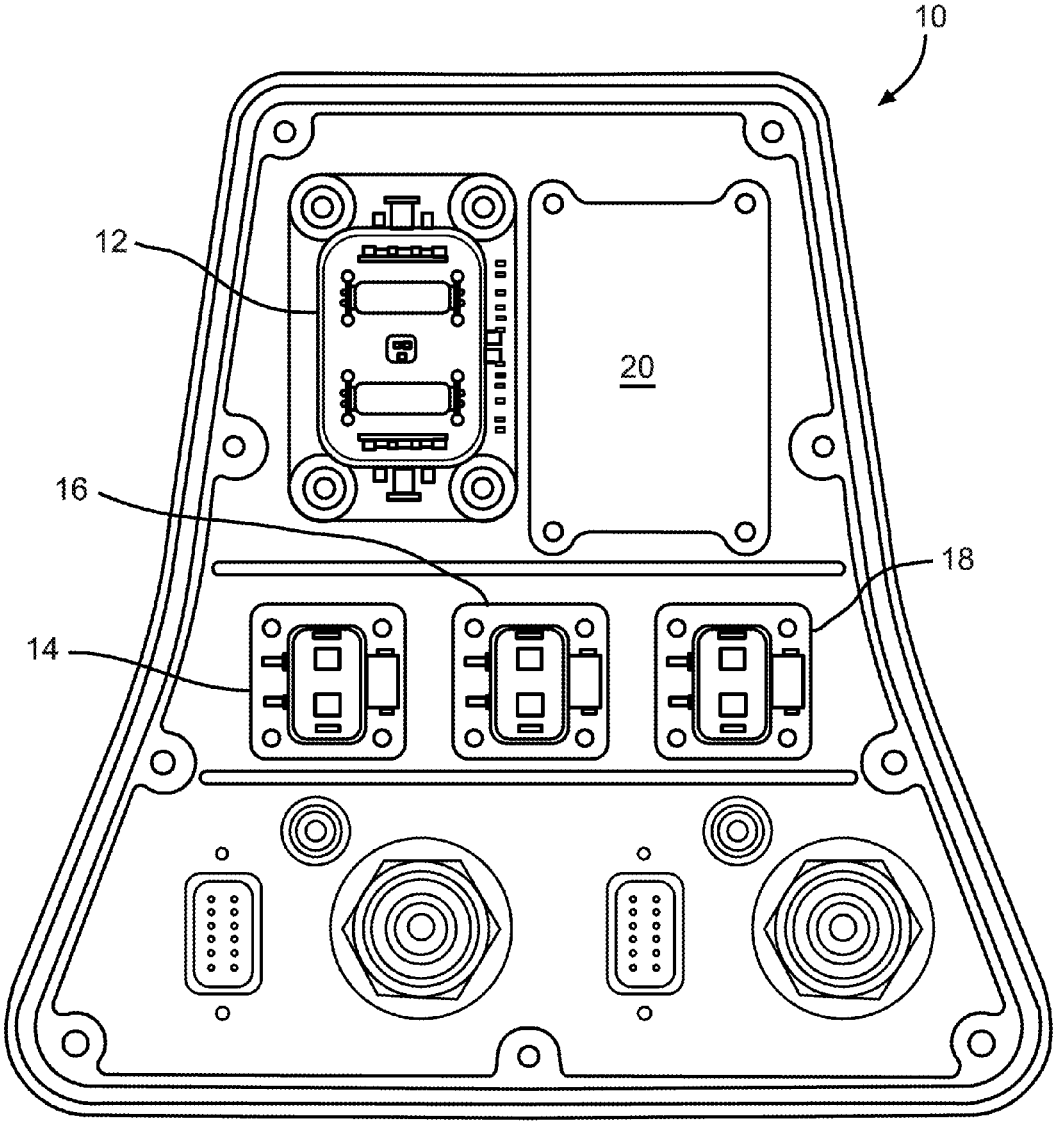
FIG. 1 Prior Art
FIG. 1 is a front plan view of a battery disconnect unit including prior art electrical connectors.

Referring to the drawings, there is shown in FIG. 1 a front plan view of a battery disconnect unit, indicated generally at

10, that is known in the art. The prior art battery disconnect unit 10 is connected to the battery of an electric vehicle (not shown), and power is supplied to components of the vehicle through the prior art battery disconnect unit 10. The prior art battery disconnected unit 10 includes four headers, 12, 14, 16, and 18. The headers 12, 14, 16, and 18 are electrical connectors that are mated with a corresponding connector (not shown) in order to provide an electric current to a circuit.

The prior art battery disconnect unit 10 also includes a fuse plate 20. The fuse plate 20 conceals and protects four fuses (not shown). The prior art battery disconnect unit 10 includes one fuse for each of the headers 12, 14, 16, and 18. In the event that a fuse needs to be replaced, the fuse plate 20 is removed by a technician in order to provide access to the fuses.

Figure 2:
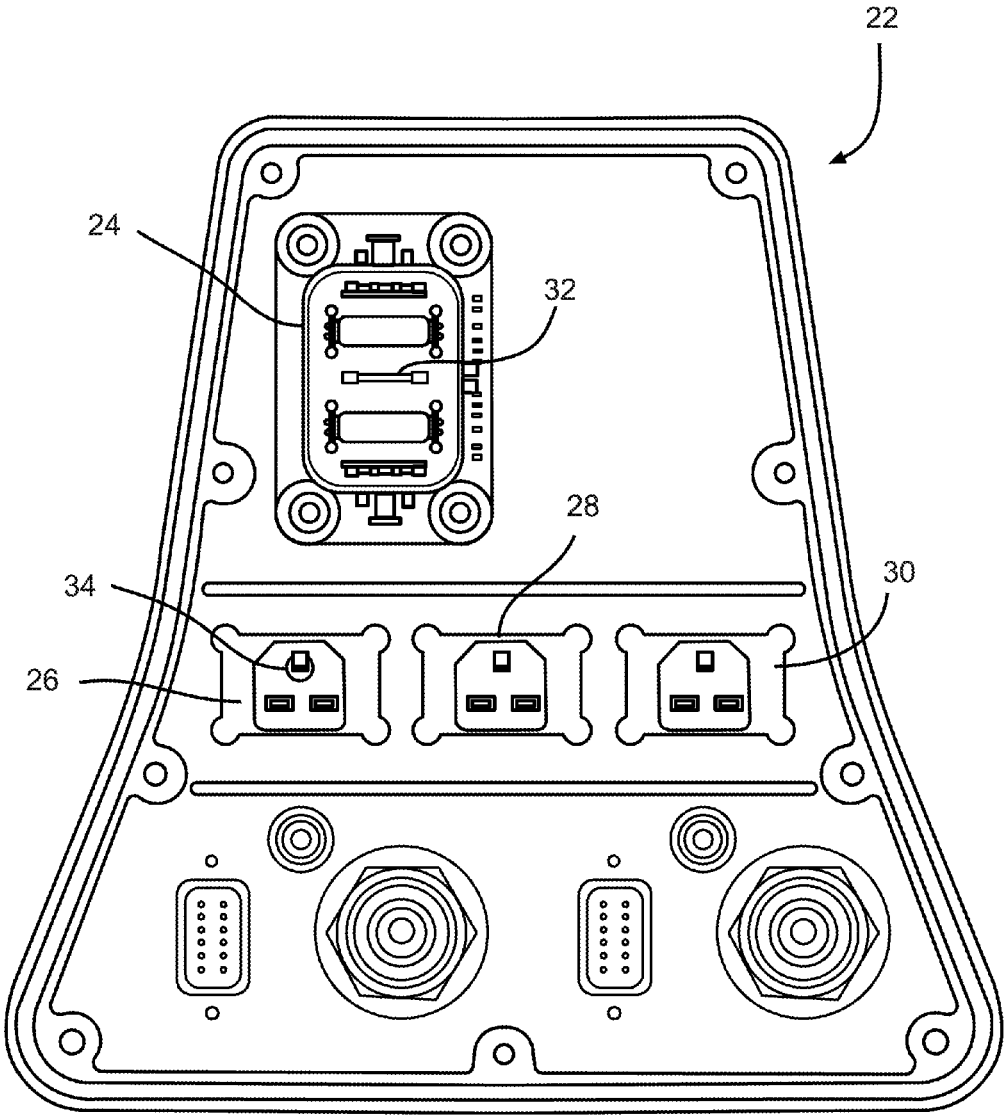
FIG. 2 is a front plan view of a battery disconnect unit including electrical connectors with integrated fuses.

Referring now to FIG. 2, there is shown an alternative battery disconnect unit 22 in accordance with this invention. The alternative battery disconnect unit 22 has many features in common with the prior art battery disconnect unit 10, and is suitable for a similar function. The alternative battery disconnect unit 22 includes four electrical connectors, 24, 26, 28, and 30. However, the alternative battery disconnect unit 22 does not include a fuse plate 20. Instead, the fuses are integrated into the connectors, 24, 26, 28, and 30.

The electrical connector 24 includes a fuse 32 installed in the electrical connector so that the fuse 32 is normally exposed for service. That is, the fuse 32 is exposed and the fuse 32 may be more easily replaced by a technician. However, when an associated electrical connector is mated to the electrical connector 24, the fuse 32 is not exposed and is not accessible for service. Therefore, the fuse 32 is covered and protected when the associated electrical connector is mated to the electrical connector 24.

Figure 3:
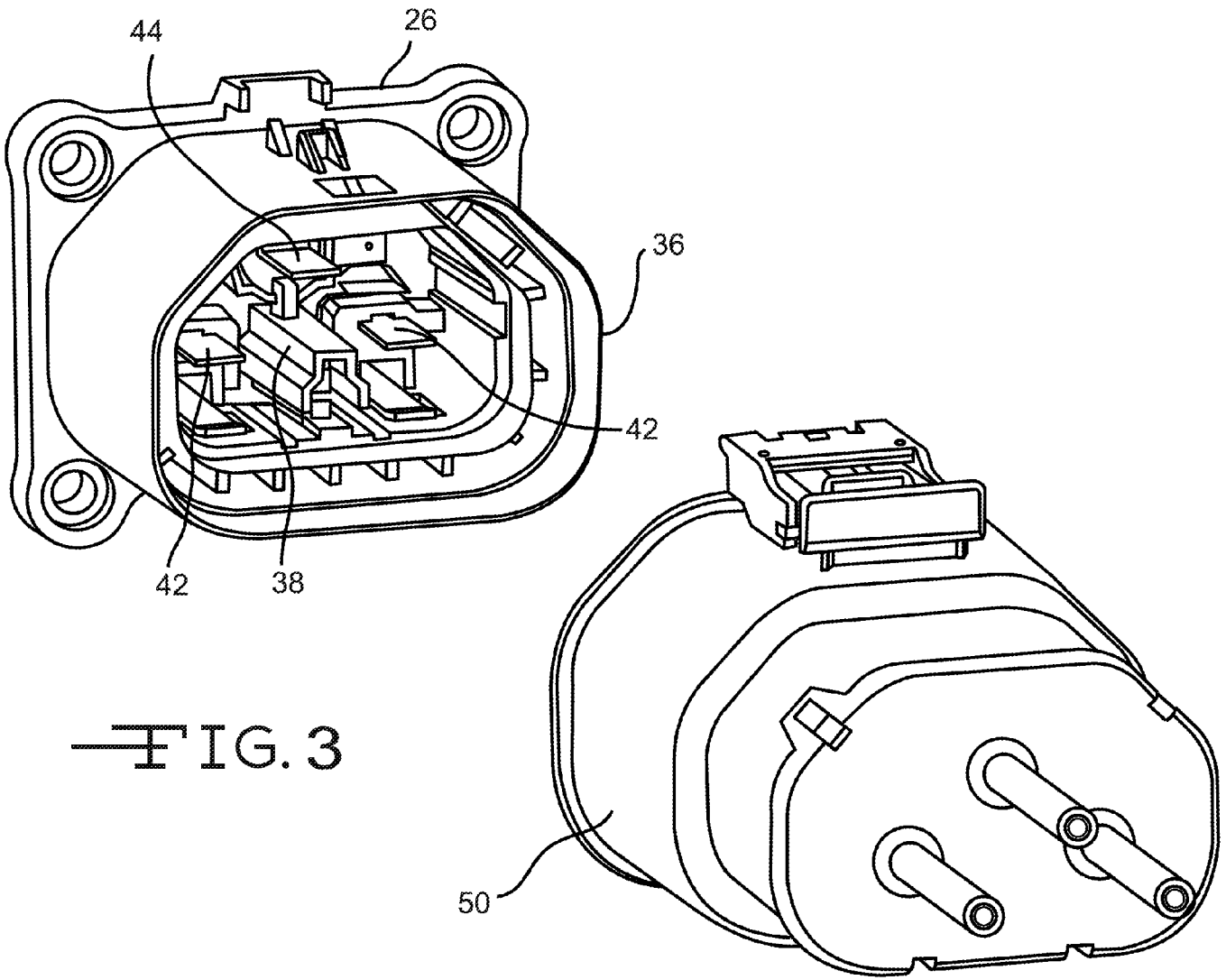
FIG. 3 is a perspective view of an electrical connector with an integrated fuse and an associated electrical connector.
Figures 4, 5:
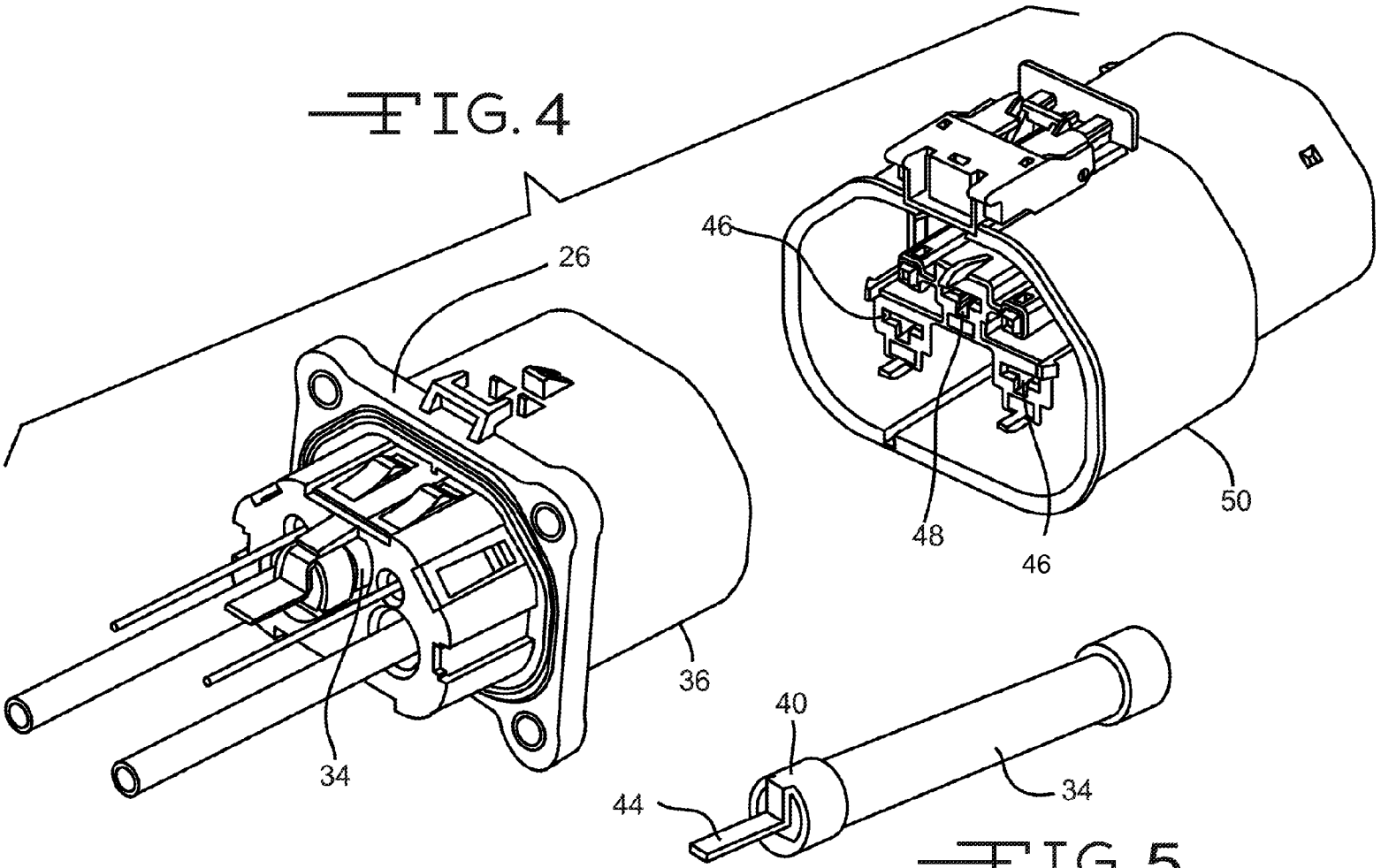
FIG. 4 is a perspective view, from behind, of the electrical connector and associated electrical connector of FIG. 3.
FIG. 5 is a perspective view of the integrated fuse of FIG. 3, shown removed from the electrical connector.

The alternative electrical connector 26 is a male header and includes an integrated fuse 34 in a different embodiment from that described for the electrical connector 24. The alternative electrical connector 26 is best shown in FIGS. 3 and 4, which show front and rear views, respectively. The alternative electrical connector 26 has an electrical connector body 36, which includes a fuse support 38 for the fuse 34. The fuse support 38 maintains the fuse 34 in proper position relative to the electrical connector body 36. The illustrated fuse support 38 is a biased locking tab, but it should be appreciated that the fuse 34 may be attached to the alternative electrical connector 26 by other desired mechanism. For example, the fuse 34 could be threaded onto complementary threads on the fuse support 38, or the fuse support 38 could provide an interference fit for the fuse 34.

As shown in FIG. 3, the alternative electrical connector 26 includes three male blade terminals. Two of the male blade terminals are fixed male blade terminals 42. The third male blade terminal 44 is part of an end cap 40 of the fuse 34. When the fuse 34 with end cap 40 is inserted into the alternative electrical connector 26, the male blade terminal 44 is positioned to act as an electrical contact terminal, similar to the fixed male blade terminals 42. The fixed male blade terminals 42 and male blade terminal 44 are positioned to engage corresponding female terminals 46 and 48, respectively (shown on FIG. 4), on an associated electrical connector 50.

As shown in FIG. 5, the male blade terminal 44 is supported by the fuse 34. If the fuse 34 is not attached to the electrical connector body 36, there will be no contact between the male blade terminal 44 and the corresponding terminal 48 when the connector body 36 is mated with the associated electrical connector 50. The end cap 40 with the male blade terminal 44 may be manufactured to be integral with the fuse 34, or may be a separate component that is attached to the fuse 34.

The end cap 40 has the shape and locking feature of a male high voltage connection blade terminal 44 in order to engage the corresponding terminal 48 on the associated electrical connector 50 when the connector body 36 is mated with the associated electrical connector 50. Therefore, when the alternative electrical connector 26 is mated with the associated electrical connector 50, the electric current will flow through the fuse 34. It should be appreciated that the three male blade terminals 42 and 44 are used for illustrative purposes only, and the alternative electrical connector 26 may have a different number male blade terminals if desired. Also, although in the illustrated alternative electrical connector 26 only one of the male blade terminals is supported by a fuse, additional male blade terminals may be supported by additional fuses, if desired. Additionally, the alternative electrical connector 26 may include female terminals instead of or in addition to the male blade terminals, if desired.

The fuse 34 installed in the alternative electrical connector 26 is normally exposed. When the associated electrical connector 50 is mated to the alternative electrical connector 26, the fuse 34 is not exposed. Therefore, the fuse 34 is covered and protected when the associated electrical connector 50 is mated to the alternative electrical connector 26. It should be appreciated that the illustrated associated electrical connector 50 is a female electrical connector that is capable of mating with the male header on the battery disconnect unit 22 in order to supply power from the battery to some other component on the vehicle.

It should be appreciated that the alternative battery disconnect unit 22 has advantages over the battery disconnect unit 10. Removing the need for the fuse plate 20 reduces the number of openings in the battery disconnect unit, which simplifies the design, reduces the amount of openings that need to be sealed, and helps reduce electromagnetic interference caused by the electrical components. Including the fuse 32 and the fuse 34 in the electrical connector 24 and alternative electrical connector 26 respectively also simplifies the wiring of the high voltage interlock loop.

It should be appreciated that electrical connector 24 and alternative electrical connector 26 illustrate two different embodiments of a connector with an integrated fuse. It is not necessary that both embodiments be used together. Further, it should be appreciated that while the embodiments of the connector with an integrated fuse have been described in connection with a battery disconnect unit, this is not the only use suitable for the connector. Any mating electrical connector may utilize the features described above. Additionally, the described embodiments illustrate the fuse integrated with the male electrical connector, but the fuse may be integrated with a female connector, if desired.

The principle and mode of operation of this invention have been explained and illustrated in its preferred embodiment. However, it must be understood that this invention may be practiced otherwise than as specifically explained and illustrated without departing from its spirit or scope.

What is claimed is:

1. An electrical connector comprising:

a connector body including at least two electric terminals and a fuse supported on the connector body;

characterized in that at least one of the electric terminals is supported by the fuse;

further comprising an associated electrical connector including at least two corresponding terminals that engage the respective electric terminals only when the connector body is mated with the associated electrical connector;

wherein if the fuse is not installed on the connector body then at least one of the corresponding terminals will not engage the respective electric terminal when the connector body is mated with the associated electrical connector; and wherein the fuse is not accessible when the connector body is mated with the associated electrical connector.

2. The electrical connector of claim 1, wherein the fuse is accessible when the connector body is not mated with the associated electrical connector.

3. The electrical connector of claim 2, wherein the fuse is exposed for service when the connector body is not mated with the associated electrical connector.

4. An electrical connector comprising:

a connector body;

a fuse supported on the connector body;

a fixed electrical terminal supported on the connector body;

an end cap electrical terminal that is supported on the fuse; and a resilient locking tab on the connector body adapted to maintain the fuse in position on the connector body.

5. The electrical connector of claim 4, wherein the end cap electrical terminal is supported on an axial end of the fuse and extends in an axial direction from the fuse.

6. The electrical connector of claim 5, wherein the fuse is removable from the connector body in the axial direction.

7. An electrical connector comprising:

a connector body;

a plurality of electric terminals supported on the connector body;

a fuse supported on the connector body;

an associated electrical connector that is adapted to mate with the connector body; and a plurality of corresponding terminals supported on the associated electrical connector and adapted to engage respective ones of the plurality of electric terminals;

wherein the associated electrical connector blocks removal of the fuse from the connector body when the connector body is mated with the associated electrical connector, and wherein one of the plurality of electric terminals is supported on an axial end of the fuse and the fuse may be removed from the connector body in an axial direction.

8. The electrical connector of claim 7, wherein the fuse is accessible when the connector body is not mated with the associated electrical connector.

9. The electrical connector of claim 7, further comprising a resilient locking tab on the connector body adapted to maintain the fuse in position on the connector body.

10. An electrical connector comprising:

a connector body;

a fuse supported on the connector body;

a fixed electrical terminal supported on the connector body; and an end cap electrical terminal that is supported on the fuse;

wherein the end cap electrical terminal is supported on an axial end of the fuse and extends in an axial direction from the fuse, and the fuse is removable from the connector body in the axial direction.

11. The electrical connector of claim 10, further comprising a resilient locking tab on the connector body adapted to maintain the fuse in position on the connector body.

* * * * *